United States Patent [19]

Noel et al.

[11] Patent Number: 4,624,716

[45] Date of Patent: Nov. 25, 1986

[54] METHOD OF TREATING A NICKEL BASE ALLOY

[75] Inventors: Robert J. Noel; Anthony Banik, both of Milwaukee County, Wis.

[73] Assignee: Armco Inc., Middletown, Ohio

[21] Appl. No.: 469,014

[22] Filed: Feb. 23, 1983

Related U.S. Application Data

[63] Continuation-in-part of Ser. No. 449,482, Dec. 13, 1982, abandoned.

[51] Int. Cl.[4] ..... C22F 1/10

[52] U.S. Cl. ..... 148/12.7 N; 148/162; 148/410

[58] Field of Search ..... 148/162, 410, 12.7 N; 420/448, 449

[56] References Cited

U.S. PATENT DOCUMENTS

| | | | |
|---|---|---|---|
| 3,061,426 | 10/1962 | Bieber | 420/448 |
| 3,653,987 | 4/1972 | Boesch | 148/162 |
| 3,667,938 | 6/1972 | Boesch | 75/171 |
| 4,083,734 | 4/1978 | Boesch | 148/32.5 |
| 4,093,476 | 6/1978 | Boesch | 148/32.5 |
| 4,121,950 | 10/1978 | Guimier et al. | 148/12.7 N |
| 4,253,884 | 3/1981 | Maurer et al. | 148/13.1 |

OTHER PUBLICATIONS

S. S. Manson, "Aerospace Structural Metals Handbook Chapter IN-100", revised 1978, pp. 1 & 6, Traverse City, MI.

Alloy Digest, "IN-100", Filing Code Ni-151, Mar. 1970, pp. 1 and 2, Upper Montclair, NJ.

Metals Handbook Ninth Edition, "Properties of Superalloys", 1980, vol. 3, pp. 242-243, Metals Park, OH.

W. F. Simmons, et al, "Guide to Selection of Superalloys", 1968, pp. 14-15, Metal Progress . . . Databook Metals Park, OH.

*Primary Examiner*—R. Dean

*Attorney, Agent, or Firm*—Frost & Jacobs

[57] ABSTRACT

A method of heat treating a nickel base superalloy comprising solution treatment at 2050° to 2150° F. (1121° to 1177° C.) for about 2 hours and cooling at a rate at least as rapid as still air; stabilization at 1750° to 1850° F. (954° to 1010° C.) for ¼ to 4 hours and cooling at a rate at least as rapid as still air; and precipitation hardening at 1350° F. (732° C.) for at least about 8 hours and air cooling. The heat treated product contains a low level of precipitated grain boundary carbides, and exhibits an optimum balance of tensile strength, stress rupture life and creep strength, along with reduced residual stress in the product.

10 Claims, 5 Drawing Figures

500 X
SOLUTION: 2090°F/2HR./OIL QUENCH
STABILIZE: 1800°F/1HR./AIR COOL
AGE: 1350°F/8HR./AIR COOL
MURAKAMI'S ETCHANT

500 X
SOLUTION: 2090°F/2 HR./OIL QUENCH
STABILIZE: 1600°F/4 HR./AIR COOL
AGE: 1350°F/8 HR./AIR COOL
MURAKAMI'S ETCHANT

500 X
SOLUTION: 2090°F/2 HR./OIL QUENCH
STABILIZE: 1700°F/1 HR./AIR COOL
AGE CYCLE DELETED
MURAKAMI'S ETCHANT

500 X
SOLUTION: 2090°F/2 HR./OIL QUENCH
STABILIZE: 1750°F/1 HR./AIR COOL
AGE CYCLE DELETED
MURAKAMI'S ETCHANT

500 X
SOLUTION: 2090°F/2HR./OIL QUENCH
STABILIZE: 1800°F/1HR./AIR COOL
AGE: 1350°F/8HR./AIR COOL
MURAKAMI'S ETCHANT

500 X

SOLUTION: 2090°F./2 HR./OIL QUENCH
STABILIZE: 1800°F./4 HR./AIR COOL
AGE: 1350°F./8 HR./AIR COOL
MURAKAMI'S ETCHANT

METHOD OF TREATING A NICKEL BASE ALLOY

CROSS-REFERENCE TO RELATED APPLICATION

This is a continuation-in-part of application Ser. No. 449,482 filed Dec. 13, 1982, abandoned.

BACKGROUND OF THE INVENTION

This invention relates to a heat treatment of a nickel base alloy to produce an article exhibiting an acceptable level of grain boundary precipitates, reduced residual stress, with an optimum balance of tensile, stress rupture and creep properties. The invention has particular utility in the production of components for gas turbine and jet engines, such as turbine discs.

For the compositions hereinafter defined, heat treatment steps are maintained within relatively narrow, critical limits which have been found to be necessary to achieve the novel combination of reduced residual stress and optimum mechanical properties, while at the same time effecting a reduction of about 50% in processing time and cost, as compared to a conventional prior art treatment of a nickel base alloy.

So-called "superalloys" which are widely used for components in gas turbine and jet engines include nickel base alloys sold under the trademarks "IN-100" by International Nickel Co., Inc. and "René 100" by General Electric Company. The International Nickel Co., Inc. alloy is disclosed in U.S. Pat. No. 3,061,426. According to "Aerospace Structural Metals Handbook Chapter IN-100", by S. S. Manson, Code 4212, 1978 revision, page 6, the composition of IN-100 is as follows:

cobalt 13–17%
chromium 8–11%
aluminum 5–6%
titanium 4.5–5.0%
aluminum plus titanium 10–11%
molybdenum 2–4%
iron 0–1%
vanadium 0.7–1.2%
boron 0.01–0.02%
carbon 0.15–0.20%
manganese 0.10% maximum
sulfur 0.015% maximum
silicon 0.15% maximum
nickel balance The same literature source indicates the composition of René 100 to be as follows:

cobalt 14–16%
chromium 9–10%
aluminum 5.3–5.7%
titanium 4.0–4.4%
molybdenum 2.7–3.3%
iron 0–1%
vanadium 0.9–1.1%
boron 0.01–0.02%
carbon 0.15–0.20%
nickel balance In this same literature source, introductory comments at page 1 include the following:

"Because of the large quantities of strengthening elements included in the composition, the alloy is not hot worked, and is therefore used in the as-cast condition. Recently, however, there has been considerable development of a powder metallurgy product which permits working of the alloy. At high temperatures the powder consolidated product becomes superplastic, thus opening many possibilities in fabrication-to-shape of wrought complex components.

"Also, because of the high content of gamma prime precipitate that constitutes one of the strengthening components of the alloy, the equilibrium solution temperature approaches the solidus, so the material is usually used in the as-cast condition, without heat treatment. However, it is subjected to heat treatment during the deposition of protective coatings. The powder metallurgy product is heat treated to achieve desirable properties."

It is next pointed out that protective coatings may be needed for high temperature applications due to the relatively low oxidation and corrosion resistance of the alloy. A number of types of coatings such as aluminizing or chromizing have been found to provide sufficient protection. Additionally, precipitation of sigma phase with resulting embrittlement has been found to occur after exposure to high temperature and stress for long periods of time. Restriction of the aluminum plus titanium contents has been found to be effective in minimizing sigma phase formation, and the limitation on the aluminum plus titanium levels is based on electron vacancy density calculations.

Page 1 of this literature source further states:

"For the powder metallurgy product, Pratt and Whitney Aircraft recommends solutioning at 2050° F., stabilization at 1600° and 1800° F., and precipitation hardening at 1200° and 1400° F. Typical heat treatment used . . . 2215° F., 4 hrs+2000° F., 4 hrs+1550° F., 16 hrs."

Data relating to IN-100 are also contained in "Alloy Digest", filing code: Ni-151, March 1970; "Properties of Superalloys/243" and "Guide to Selection of Superalloys", pages 14 and 15, W. F. Simmons et al.

United States Patents relating to nickel base alloys and treatment thereof include U.S. Pat. Nos. 3,653,987; 3,667,938; 4,083,734; 4,093,476; 4,121,950 and 4,253,884.

U.S. Pat. No. 3,653,987, issued Apr. 4, 1972 to W. J. Boesch, discloses an alloy consisting essentially of up to 0.18% carbon, 14.2 to 20% cobalt, 13.7 to 16% chromium, 3.8 to 5.5% molybdenum, 2.75 to 3.75% titanium, 3.75 to 4.75% aluminum, up to 4% iron, 0.005 to 0.035% boron, up to 0.5% zirconium, up to 0.5% hafnium, up to 0.75% columbium, up to 0.5% rhenium, up to 0.75% tantalum, up to 1.0% manganese, up to 3% tungsten, up to 0.5% rare earth metals, and balance essentially nickel with incidental impurities. This alloy is heat treated to develop gamma prime particles consisting essentially of randomly dispersed irregularly shaped particles less than 0.35 micron in diameter. The treatment involves heating at a temperature of at least 2000° F., cooling, and heating at a temperature of about 1500° to about 1850° F. An optional third stage of heat treatment for precipitation hardening may be conducted at 1350° to 1450° F. This patent points out that a prior art heat treatment for nickel base alloys comprised the steps of heating at a temperature of 2135° F. for 4 hours and cooling; heating at a temperature of 1975° F. for 4 hours and cooling; heating at a temperature of 1550° F. for 4 hours and cooling; and heating at a temperature of 1400° F. for 16 hours and cooling.

U.S. Pat. No. 4,083,734, issued Apr. 11, 1978 to W. J. Boesch, discloses a nickel base alloy consisting essentially of from 12.0 to 20.0% chromium, 4.75 to 7.0% titanium, 1.3 to 3.0% aluminum, 13.0 to 19.0% cobalt, 2.0 to 3.5% molybdenum, 0.5 to 2.5% tungsten, 0.005 to 0.03% boron, 0.005 to 0.045% carbon, up to 0.75% manganese, 0.01 to 0.08% zirconium, up to 0.5% iron, up to 0.2% rare earth elements, up to 0.02% of magnesium, calcium, strontium, barium, and mixtures thereof, and balance essentially nickel, with titanium plus aluminum from 6.5 to 9.0%. A maximum carbon level of 0.045% is alleged to increase the hot impact strength of the alloy without adversely affecting stress rupture properties. An exemplary treatment for a wrought alloy of this patent was heating at 2150° F. for 4 hours and air cooling; heating at 1975° F. for 4 hours and air cooling; heating at 1550° F. for 24 hours and air cooling; and heating at 1400° F. for 16 hours and air cooling.

U.S. Pat. No. 4,093,476, issued June 6, 1978 to W. J. Boesch, differs from U.S. Pat. No. 4,083,734 principally in permitting from 0.05 to 0.15% carbon and requiring from 0.031% to 0.048% boron. Carbon within the range of 0.02% to 0.04% and boron within the range of 0.032% to 0.045% are alleged to provide the best combination of stress rupture life and impact strength. An exemplary heat treatment of this patent differed from that of U.S. Pat. No. 4,083 734 only by specifying a first heating step of 2135° F. for 4 hours.

U.S. Pat. No. 4,121,950, issued Oct. 24, 1978 to A. R. Guimier et al, discloses a nickel base alloy consisting essentially of 13 to 20% cobalt, 13 to 19% chromium, 3% to 6% molybdenum, tungsten or mixtures thereof, 0.01 to 0.20% carbon, 2 to 4% aluminum, 0.10 to 3% titanium, 0.30 to 1.50% hafnium and remainder nickel. The heat treatment process is described and claimed functionally as "(a) placing at least a portion of the gamma prime phase back into solution, (b) effecting the coalescence of carbides and the initiation of the reprecipitation of the gamma prime phase, and (c) completing the reprecipitation of the gamma prime phase."- The actual steps involve heating at about 1050° to 1200° C. for at least one hour and cooling; heating at about 850° C. for 10 to 30 hours and cooling; and heating at about 760° C. from 10 to 30 hours. Preferably aluminum plus titanium ranges between about 4% and 7% with the ratio of titanium to aluminum about 0.20 to 1.5.

U.S. Pat. No. 4,253,884, issued Mar. 3, 1981 to G. E. Maurer et al, discloses a method of heat treating and incorporating a coating operation therewith for a nickel base alloy consisting essentially of from 12.0 to 20.0% chromium, 4.0 to 7.0% titanium, 1.2 to 3.5% aluminum, 12.0 to 20.0% cobalt, 2.0 to 4.0% molybdenum, 0.5 to 2.5% tungsten, 0.005 to 0.048% boron, 0.005 to 0.15% carbon, up to 0.75% manganese, up to 0.5% silicon, up to 1.5% hafnium, up to 0.1% zirconium, up to 1.0% iron, up to 0.2% rare earth elements, up to 0.1% magnesium, calcium, strontium, barium and mixtures thereof, up to 6.0% rhenium and/or ruthenium, and balance essentially nickel, with titanium plus aluminum being from 6.0 to 9.0% and a titanium to aluminum ratio of 1.75 to 3.5. The heat treatment to which this alloy is subjected comprises heating at a temperature of at least 2050° F., cooling; heating between 1800° and 2000° F., cooling; heating between 1500° and 1800° F.; coating the alloy with a cobalt, nickel or iron base alloy; heating the coated alloy to a temperature of at least 1600° F., cooling; and heating the alloy within the range of 1300° and 1500° F.

It is therefore evident that there are numerous specific compositions within the general class of nickel base superalloys and a variety of heat treatments therefor. All heat treatments of which applicants are aware appear to have in common the objective of placing in solution the gamma prime particles or phase which is composed of $M_3(Al, Ti)$ wherein M is primarily nickel with relatively minor amounts of chromium and molybdenum. Thereafter the next stage of heat treatment is for the purpose of reprecipitating the gamma prime phase and to form a grain boundary precipitate of metal carbides. The third stage (if practiced) is a precipitation hardening or aging treatment wherein nickel, aluminum and titanium compounds are precipitated. In substantially all the prior art patents discussed above it is pointed out that MC carbides are precipitated in the grain boundaries, with M being principally titanium, molybdenum and/or chromium. Even in U.S. Pat. No. 4,083,734, which limits carbon to a maximum of 0.045%, it is emphasized that carbides are formed and precipitate in the grain boundaries, but it is alleged that the carbon level specified in this patent inhibits transformation in service of MC carbides to $M_{23}C_6$ carbides (wherein M is predominantly chromium), the latter being alleged to be responsible for a loss of hot impact strength.

SUMMARY OF THE INVENTION

The present invention constitutes a discovery that control of the formation of carbide precipitates in the grain boundaries results in improvement in mechanical properties, particularly stress rupture life. At the same time the composition responds to a simplified heat treatment process of relatively short duration which reduces residual stresses in articles and obtains optimum tensile and creep strength properties.

The method of the invention is applicable inter alia, to isothermal forgings produced from hot isostatically pressed powdered alloys, to forgings produced from forward extrusion consolidated billets, to components used in the direct hot isostatically pressed condition, and to components forged from material produced by advanced vacuum melting methods.

According to the invention there is provided a method of heat treating an article fabricated from a nickel base alloy consisting essentially of, in weight percent, from 0.015% to 0.09% carbon, up to 0.020% manganese, up to 0.10% silicon, up to 0.010% phosphorus, up to 0.010% sulfur, 10.90% to 13.90% chromium, 18.00% to 19.00% cobalt, 2.80% to 3.60% molybdenum, 4.15% to 4.50% titanium, 4.80% to 5.15% aluminum, 0.016% to 0.024% boron, up to 0.50% hafnium, up to 1.60% columbium, 0.04% to 0.08% zirconium, up to 0.05% tungsten, up to 0.98% vanadium, up to 0.30% iron, up to 0.07% copper, up to 0.0002% (2 ppm) lead, up to 0.00005% (0.5 ppm) bismuth, and balance essentially nickel, said method comprising the steps of:

(1) solution treating at 2050° to 2150° F. (1121° to 1177° C.), for about 2 hours and cooling at a rate at least as rapid as still air:

(2) stabilizing at 1750° to 1850° F. (954° to 1010° C.) for ¼ to 4 hours and cooling at a rate at least as rapid as still air;

(3) precipitation hardening at about 1350 °F. (732° C.) for about 8 hours and cooling at a rate at least as rapid as still air;

whereby to precipitate grain boundary carbides to an acceptable low level, to obtain an optimum balance of tensile strength, stress rupture life, creep strength and reduced residual stress in the article.

The invention further provides a heat treated article fabricated from the nickel base alloy defined above, said article having a yield strength of at least 140 ksi (98.43 kg/mm$^2$), a tensile strength of at least 215 ksi (136.4 kg/mm$^2$) and a percent elongation of at least 15% at room temperature, a combination bar stress rupture life of at least 23 hours at 1350° F. (732° C.) and at least 92.5 ksi stress, and substantial freedom from deleterious grain boundary carbide precipitates.

DETAILED DESCRIPTION

The heat treatment process of the present invention results in formation of randomly dispersed, irregularly shaped gamma prime particles and carbides throughout the grains of the alloy, rather than substantial concentrations of carbides along grain boundaries.

The above-mentioned U.S. Pat. No. 3,653,987 states at column 3, lines 12–16:

"The second stage of the heat treatment is designed to initiate the formation of and form the randomly dispersed irregularly shaped fine gamma prime particles and to form a grain boundary precipitate, $M_{23}C_6$ (M is generally chromium which improves grain boundary ductility."

Figure 1:
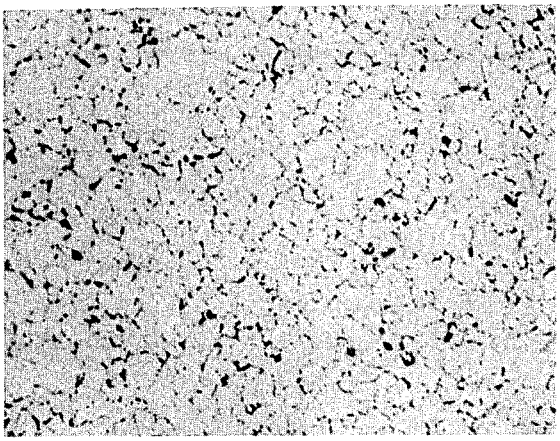
FIG. 1 is a photomicrograph at 500× of a forged sample solution treated at 2090° F. for 2 hours, oil quenched; stabilized at 1600° F. for 4 hours Furnace Time, air cooled; and aged at 1350° F. for 8 hours, air cooled.

Contrary to the teaching of this patent, applicants have discovered that extensive carbide grain boundary precipitates adversely affect stress rupture life. This problem is avoided in the present invention by conducting a stabilizing heating step at a relatively high temperature (1750° to 1850° F.). In the exemplary disclosure of U.S. Pat. No. 3,653,987 a carbon content of 0.08% was used, and the "second stage" heat treatments were conducted at 1975° F., 1700° F., and 1750° F., respectively. Similarly, it is clear from FIGS. 1 and 2 of U.S. Pat. No. 4,083,734 and column 2, lines 39–42 and column 3, lines 1–3 of U.S. Pat. No. 4,253,884 that carbide particles are precipitated at the grain boundaries, and this is considered desirable.

Within the above broad composition ranges, the following narrower compositions represent alloys which have recently become commercially available, and which respond to the improved heat treatment of the present invention:

| | 1 Weight Percent | |
|---|---|---|
| | Powder Metallurgy | Vacuum Remelted |
| Carbon | 0.015–0.035 | 0.015–0.035 |
| Manganese | 0.020 max. | 0.020 max. |
| Silicon | 0.10 max. | 0.10 max. |
| Phosphorus | 0.010 max. | 0.010 max. |
| Sulfur | 0.010 max. | 0.010 max. |
| Chromium | 11.90–12.90 | 10.90–13.90 |
| Cobalt | 18.00–19.00 | 18.00–19.00 |
| Molybdenum | 2.80–3.60 | 2.80–3.60 |
| Titanium | 4.15–4.50 | 4.15–4.50 |
| Aluminum | 4.80–5.15 | 4.80–5.15 |
| Boron | 0.016–0.024 | 0.016–0.024 |
| Hafnium | 0.30–0.50 | 0.30–0.50 |
| Columbium | 1.20–1.60 | 1.20–1.60 |
| Zirconium | 0.04–0.08 | 0.04–0.08 |
| Tungsten | 0.05 max. | 0.05 max. |
| Iron | 0.30 max. | 0.30 max. |
| Copper | 0.07 max. | 0.07 max. |
| Vanadium | 0.10 max. | — |
| Lead | 0.0002 (2 ppm) max. | 0.0002 (2 ppm) max. |
| Bismuth | 0.00005 (0.5 ppm) max. | 0.00005 (0.5 ppm) max. |
| Oxygen | 0.020 (200 ppm) max. | — |
| Nitrogen | 0.005 (50 ppm) max. | — |
| Nickel | Remainder | Remainder |

| | 2 Weight Percent | |
|---|---|---|
| | Powder Metallurgy | Vacuum Remelted |
| Carbon | 0.05–0.09 | 0.05–0.09 |
| Manganese | 0.020 max. | 0.020 max. |
| Silicon | 0.10 max. | 0.10 max. |
| Phosphorus | 0.010 max. | 0.010 max. |
| Sulfur | 0.010 max. | 0.010 max. |
| Chromium | 11.90–12.90 | 10.90–13.90 |
| Cobalt | 18.00–19.00 | 18.00–19.00 |
| Molybdenum | 2.80–3.60 | 2.80–3.60 |
| Titanium | 4.15–4.50 | 4.15–4.50 |
| Aluminum | 4.80–5.15 | 4.80–5.15 |
| Boron | 0.016–0.024 | 0.016–0.024 |
| Vanadium | 0.58–0.98 | 0.58–0.98 |
| Zirconium | 0.04–0.08 | 0.04–0.08 |
| Tungsten | 0.05 max. | 0.05 max. |
| Columbium & Tantalum | 0.04 max. | 0.04 max. |
| Iron | 0.30 max. | 0.30 max. |
| Copper | 0.07 max. | 0.07 max. |
| Lead | 0.0002 (2 ppm) max. | 0.0002 (2 ppm) max. |
| Bismuth | 0.00005 (0.5 ppm) max. | 0.00005 (0.5 ppm) max. |
| Oxygen | 0.010 (100 ppm) max. | — |
| Nickel | Remainder | Remainder |

| | 3 Weight Percent | |
|---|---|---|
| | Powder Metallurgy | Vacuum Remelted |
| Carbon | 0.015–0.035 | 0.015–0.035 |
| Manganese | 0.020 max. | 0.020 max. |
| Silicon | 0.10 max. | 0.10 max. |
| Phosphorus | 0.010 max. | 0.010 max. |
| Sulfur | 0.010 max. | 0.010 max. |
| Chromium | 11.90–12.90 | 10.90–13.90 |
| Cobalt | 18.00–19.00 | 18.00–19.00 |
| Molybdenum | 2.80–3.60 | 2.80–3.60 |
| Titanum | 4.15–4.50 | 4.15–4.50 |
| Aluminum | 4.80–5.15 | 4.80–5.15 |
| Boron | 0.016–0.024 | 0.016–0.024 |
| Hafnium | 0.30 max. | 0.03 max |
| Columbium | 1.20–1.60 | 1.20–1.60 |
| Zirconium | 0.04–0.08 | 0.04–0.08 |
| Tungsten | 0.05 max. | 0.05 max. |

-continued

| | 3 Weight Percent | |
|---|---|---|
| | Powder Metallurgy | Vacuum Remelted |
| Iron | 0.30 max. | 0.3 max. |
| Copper | 0.07 max. | 0.07 max. |
| Vanadium | 0.10 max. | — |
| Lead | 0.0002 (2 ppm) max. | 0.0002 (2 ppm) max. |
| Bismuth | 0.00005 (0.5 ppm) max. | 0.00005 (0.5 ppm) max. |
| Oxygen | 0.020 (200 ppm) max. | — |
| Nitrogen | 0.005 (50 ppm) max. | — |
| Nickel | Remainder | Remainder |

A series of billets was prepared by hot isostatic compression of nickel base alloy powders within the ranges of alloy 1 above. The billets were $6\frac{1}{4}$ inch diameter and were prepared in accordance with existing specifications by heating to a temperature of 2110° to 2140° F. (1154° to 1171° C.) for 2.5 to 3.5 hours at 15 ksi pressure (10.55 kg/mm$^2$). Half the billet material comprised −325 mesh powder (U.S. Standard), i.e. passing sieve openings of 0.044 mm, and the other half comprised −100 mesh powder, i.e. passing 0.149 mm sieve openings. The compositions of the experimental billets are set forth in Table I. The first two compositions set forth in Table I were prepared from −325 mesh powder while the remaining compositions were prepared from −100 mesh powder.

For identification purposes the samples from the various billets were designated as follows:

| Powder Size | Example | Serial No. |
|---|---|---|
| −325 mesh | A | A1 |
| −325 mesh | B | B1 |
| −100 mesh | C | C1 |
| −100 mesh | D | D1 |

The initial heat treatment conditions were modifications of existing prescribed requirements for components of this type which were as follows:

Solution treat at 2125° F. for 2 hours, 60 second delay and oil quench.

Stabilize by preheating furnace to 1600° F., hold 40 minutes after furnace has recovered to 1600° F. and air cool. Preheat furnace to 1800° F., hold 45 minutes after furnace has recovered to 1800° F. and air cool.

Age at 1200° F. for 24 hours and air cool followed by heating at 1400° F. for 16 hours and air cool.

The selected heat treatment sequence was derived for test purposes as a modification of the above standard treatment utilizing time at temperature as a basis for the stabilizing cycle, and applied to Serial Nos. A1, B1, C1 and D1 as follows:

| | |
|---|---|
| | Serial No. A1A |
| Serial No. A1: | |
| Solution Treat | 2090 F./2 hrs./OQ |
| Stabilize | Hold |
| Age | Hold |
| | Serial No. A1B |
| Serial No. A1: | |
| Solution Treat | 2090 F./2 hrs./OQ |
| Stabilize | 1600 F./1 hr./AC |
| Age | 1350 F./8 hrs./AC |
| | Serial No. B1A |
| Serial No. B1: | |
| Solution Treat | 2090 F./2 hrs./90 sec.DOQ |
| Stabilize | 1500 F./1 hr./AC |
| Age | 1350 F./8 hrs./AC |
| | Serial No. B1B |
| Serial No. B1: | |
| Solution Treat | 2090 F./2 hrs./90 sec.DOQ |
| Stabilize | 1600 F./1 hr./AC |
| Age | 1350 F./8 hrs./AC |
| | Serial No. C1A |
| Serial No. C1: | |
| Solution Treat | 2065 F./2 hrs./OQ |
| Stabilize | 1600 F./1 hr./AC |
| Age | 1350 F./8 hrs./AC |
| | Serial No. C1B |
| Serial No. C1: | |
| Solution Treat | 2065 F./2 hrs./OQ |
| Stabilize | Hold |
| Age | Hold |
| | Serial No. D1A |
| Serial No. D1: | |
| Solution Treat | 2090 F./2 hrs./OQ |
| Stabilize | 1600 F./1 hr./AC |
| Age | 1350 F./8 hrs./AC |
| | Serial No. D1B |
| Serial No. D1: | |
| Solution Treat | 2065 F./2 hrs./OQ |
| Stabilize | 1600 F./1 hr./AC |
| Age | 1350 F./8 hrs./AC |

Serial Nos. A1, B1 and C1 were sectioned in half after solution treatment.

Serial Nos. A1A and C1B were held after solution treatment, while the remainder of the samples were subjected to stabilizing and aging heat treatment and cross-sectional testing.

The mechanical properties of the cross-sectioned specimens are set forth in Table II.

Serial No. B1A exhibited acceptable tensile strength and ductility while Serial No. D1A exhibited optimum stress rupture life. However, this first iteration heat treatment did not produce the combination of tensile ductility and stress rupture life required for gas turbine and jet engine components.

Additional heat treatment sequences were performed on the remaining material from the forging half sections Serial Nos. A1B, B1A, B1B and D1A. In this second heat treatment iteration the samples were identified as A1BT, B1AT, B1BT and D1AT, respectively. The heat treat cycles were as follows:

| | |
|---|---|
| | Serial No. A1BT |
| Serial No. A1B: | |
| Solution Treat | 2090 F./2 hrs./Direct Oil Quench |
| Stabilize | 1600 F./40 min/AC<br>1800 F./45 min/AC |
| Age | 1350 F./8 hrs./AC |
| | Serial No. B1AT |
| Serial No. B1A: | |
| Solution Treat | 2090 F./2 hrs./Direct Oil Quench |
| Stabilize | 1750 F./4 hrs. total furnace time with 2 hrs. min. at temp./AC |
| Age | 1350 F./8 hrs./AC |
| | Serial No. B1BT |
| Serial No. B1B: | |
| Solution Treat | 2090 F./2 hrs./Direct Oil Quench |
| Stabilize | None |
| Age | 1350 F./8 hrs./AC |
| | Serial No. D1AT |
| Serial No. D1A: | |
| Solution Treat | 2090 F./2 hrs./Direct Oil Quench |
| Stabilize | 1600 F./30 min. total furnace time with max. metal temp. of 1400 F./AC |

-continued

| | |
|---|---|
| Age | 1350 F./8 hrs./AC |

Mechanical properties of the second heat treat iteration are summarized in Table III. The higher stabilizing heat treatments Serial No. A1BT and Serial No. B1AT reduced residual stress from the oil quench after solution treatment while at the same time produced acceptable tensile and stress rupture properties.

Microstructural samples from the heat treatments were polished and etched with Murakami's etchant, and a grain boundary precipitate was evident on the samples from each heat treat section. However, a reduced amount of precipitate was present in samples which had a minimum exposure in the 1600° to 1750° F. temperature range. A microspecimen from Serial No. B1BT (which was not previously stabilized) was stabilized at 1800° F. for one hour and air cooled, and this exhibited virtual freedom from grain boundary precipitate.

Figure 4:
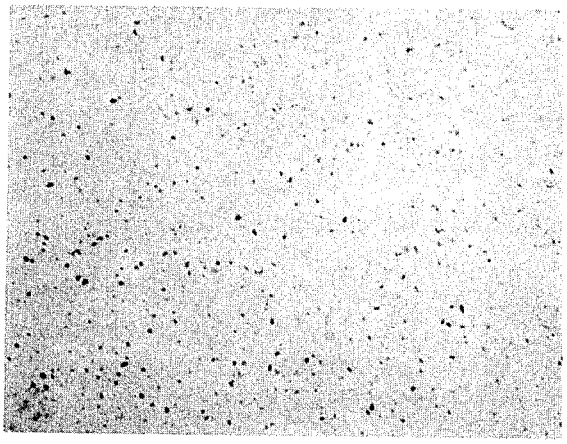
FIG. 4 is a photomicrograph at 500× of a forged sample solution treated at 2090° F. for 2 hours, oil quenched; stabilized at 1800° Fo for 1 hour, air cooled; and aged at 1350° F. for 8 hours, air cooled.
Figure 5:
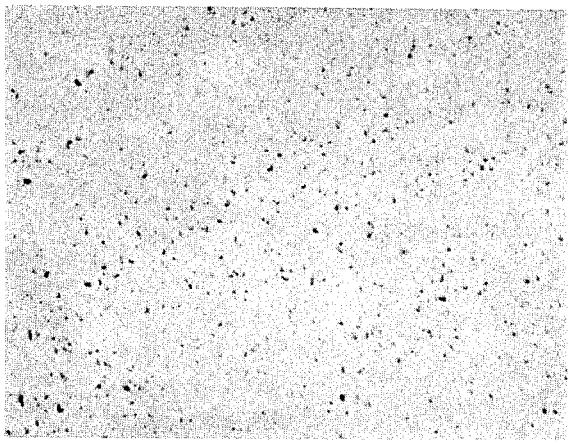
FIG. 5 is a photomicrograph at 500× of a forged sample solution treated at 2090° F., oil quenched; stabilized at 1800° F. for 4 hours, air cooled; and aged at 1350° F. for 8 hours, air cooled.

Additional bars were obtained from Serial No. A1A and Serial A1B material and were used to develop a microstructural phase diagram for the grain boundary precipitate. The gradient bar study was conducted with stabilizing temperature ranges between 1500° and 1800° F. for time periods ranging from ½ to 4 hours. FIGS. 1 through 5 are photomicrographs of representative polished and etched samples. It is evident from FIGS. 1 and 2 that relatively massive precipitation occurs along grain boundaries by stabilizing at 1600° and 1700° F., respectively. In FIG. 3, wherein stabilization was at 1750° F. for 1 hour, less grain boundary carbide precipitates were evident. In FIGS. 4 and 5, wherein stabilization was conducted at 1800° F., for 1 hour and 4 hours, respectively, it is apparent that the precipitates were randomly dispersed and irregularly shaped with no concentration of precipitates along grain boundaries. Since a temperature of 1750° F. appears to be the upper limit at which grain boundary precipitation occurs, the range of 1750° to 1850° F. for a time period of ¼ to 4 hours, is considered to be the operative conditions for the stabilizing step of the method of the present invention. A maximum of 1850° F., should be observed in order to avoid tensile yield and ultimate strength degradation.

Figure 2:
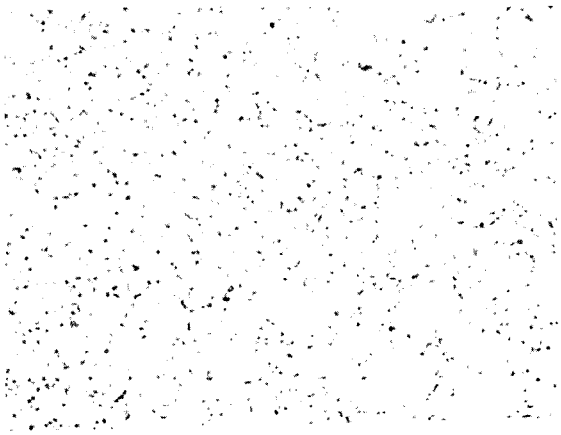
FIG. 2 is a photomicrograph at 500× of a forged sample solution treated at 2090° F. for 2 hours, oil quenched; stabilized at 1700° F. for 1 hour, air cooled; no aging.
Figure 3:
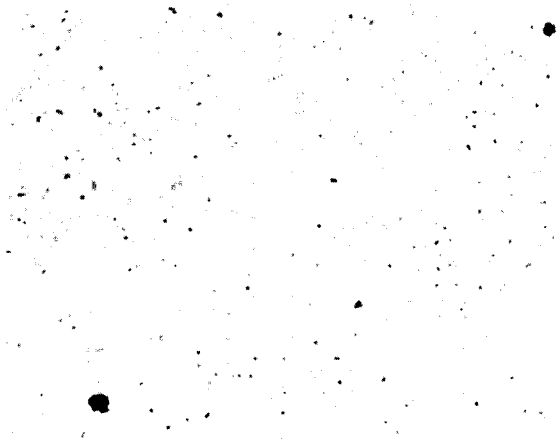
FIG. 3 is a photomicrograph at 500× of a forged sample solution treated at 2090° F. for 2 hours, oil quenched; stabilized at 1750° F. for 1 hour, air cooled; no aging.

Since the samples of FIGS. 2 and 3 were not subjected to the standard aging or precipitation hardening treatment, it is evident that this treatment does not affect concentrations of precipitates along grain boundaries. Rather, this is a function of the stabilizing heat treatment conducted between 1750° and 1850° F. in accordance with the present invention.

Remaining half sections of Serial No. A1A and C1B were sectioned and identified as Serial Nos. A1AA, A1AB, C1BA and C1BB, respectively. These quarter sections were heat treated as follows:

| | |
|---|---|
| | Serial No. A1AA |
| Serial No. A1A: | |
| Solution Treat | 2090 F./2 hrs./90 sec. Oil Quench Delay |
| Stabilize | 1800 F./2 hrs./AC |
| Age | 1350 F./8 hrs./AC |
| | Serial No. A1AB |
| Serial. No. A1A: | |
| Solution Treat | 2090 F./2 hrs./90 sec. Oil Quench Delay |
| Stabilize | 1800 F./4 hrs./AC |

-continued

| | |
|---|---|
| Age | 1350 F./8 hrs./AC |
| | Serial No. C1BA |
| Serial No. C1B: | |
| Solution Treat | 2090 F./2 hrs./90 sec. Oil Quench Delay |
| Stabilize | 1600 F./1 hr./AC |
| Age | 1350 F./8 hrs./AC |
| Re-Stabilize | 1800 F./Time to reach temp./AC |
| Re-Age | 1350 F./8 hrs./AC |
| | Serial No. C1BB |
| Serial No. C1A: | |
| Solution Treat | 2090 F./2 hrs./90 sec. Oil Quench Delay |
| Stabilize | 1600 F./30 min. total furnace time with max. metal temp. of 1400 F./AC |
| Age | 1350 F./8 hrs./AC |

Mechanical properties of these samples are summarized in Table IV. Although the data for the four different heat treat conditions met the component property goals, the results indicate grain boundary carbide precipitation is affecting the stress rupture—creep property response. The best balance of creep and stress rupture values was obtained with a minimum exposure at 1800° F. (Serial No. C1BA) but this cycle would not be practical from a production control viewpoint. The 1600° F. furnace exposure (Serial No. C1BB) would not provide an adequate stress relief. Therefore, a stabilizing cycle of 1800° F. for 1 hour at temperature would provide the best property balance, an effective stress relief and heat treat control in a production situation.

A full-scale component test program was next performed. The stabilizing cycle was modified to include a fan air cool in order to accommodate the larger cross section of components and furnace loads. Mechanical properties of a cross-section component, which was a first stage turbine disc, are set forth in Table V, while mechanical properties of another cross section component, which was a second stage turbine disc, are summarized in Table VI. As will be apparent from these tables the mechanical properties substantially exceeded the goal of the manufacturer of the components in all instances.

The grain sizes reported in Tables II, V and VI indicate a uniform microstructure of desirably small average grain size after heat treatment, with an average of ASTM 11 to 12, with occasional grains as large as ASTM 8 or 9.

An alloy within the ranges of commercial alloy 2 above was fabricated into engine components which were subjected to the heat treatment method of the present invention, viz.:

| | |
|---|---|
| Solution Treat | 2050° F./2 hrs./OQ |
| Stabilize | 1815° F./45 min./AC |
| Age | 1200° F./24 hours/AC<br>1400° F./4 hrs./AC |

The properties of these components after heat treatment are summarized in Table VII. It is evident that the properties were substantially superior to the minimum goals established for these components.

TABLE I

| CHEMICAL ANALYSIS | | | | |
|---|---|---|---|---|
| | Percent by Weight | | | |
| ELEMENT | Example A | Example B | Example C | Example D |

TABLE I-continued

| | | | | |
|---|---|---|---|---|
| Carbon | 0.031 | 0.031 | 0.027 | 0.032 |
| Manganese | <0.01 | <0.01 | <0.01 | <0.01 |
| Silicon | 0.08 | 0.06 | 0.06 | 0.06 |
| Phosphorus | 0.002 | 0.002 | 0.001 | 0.002 |
| Sulfur | 0.0012 | 0.0014 | 0.0012 | 0.0012 |
| Chromium | 12.26 | 12.26 | 12.26 | 12.25 |
| Cobalt | 18.05 | 18.03 | 18.10 | 18.06 |
| Molybdenum | 3.27 | 3.29 | 3.29 | 3.26 |
| Titanium | 4.23 | 4.24 | 4.24 | 4.24 |
| Aluminum | 5.15 | 5.10 | 5.15 | 5.14 |
| Boron | 0.018 | 0.018 | 0.017 | 0.018 |
| Hafnium | 0.39 | 0.49 | 0.50 | 0.44 |
| Columbium | 1.38 | 1.39 | 1.39 | 1.38 |
| Zirconium | 0.07 | 0.07 | 0.08 | 0.08 |
| Tungsten | 0.05 | 0.05 | <0.05 | <0.05 |
| Iron | 0.08 | 0.09 | 0.09 | 0.09 |
| Copper | <0.05 | <0.05 | <0.05 | <0.05 |
| Lead | 0.00006 | 0.00004 | 0.00007 | 0.00004 |
| Bismuth | 0.00001 | 0.00000 | 0.00001 | 0.00000 |
| Oxygen | 0.015 | 0.014 | 0.010 | 0.008 |
| Nitrogen | 0.002 | 0.002 | 0.002 | 0.002 |
| Nickel | 54.98 | 54.91 | 54.78 | 54.94 |

GAS ANALYSIS

| | HYDROGEN | | OXYGEN | | NITROGEN | |
|---|---|---|---|---|---|---|
| Example | 0° | 180° | 0° | 180° | 0° | 180° |
| Ex. A | 0.00085 | 0.00058 | 0.0146 | 0.0129 | 0.0022 | 0.0018 |
| Ex. B | 0.00046 | 0.00036 | 0.0141 | 0.0134 | 0.0016 | 0.0016 |
| Ex. C | 0.00055 | 0.00043 | 0.0102 | 0.0094 | 0.0025 | 0.0018 |
| Ex. D | 0.00044 | 0.00041 | 0.0085 | 0.0084 | 0.0016 | 0.0018 |

TABLE II

MECHANICAL PROPERTIES - FIRST HEAT TREAT ITERATION

| | ROOM TEMPERATURE TENSILE | | | | 1150° F. ELEVATED TEMPERATURE TENSILE | | | |
|---|---|---|---|---|---|---|---|---|
| | Y.S. (KSI) | U.S. (KSI) | % EL | % RA | Y.S. (KSI) | U.S. (KSI) | % EL | % RA |
| A1B Example A solution 2090° F./2 Hrs./Direct Oil Quench Stabilize 1600° F./1 Hour/AC Age 1350° F./8 Hrs./AC | | | | | | | | |
| | 165 | 240 | 17 | 16 | 162 | 220 | 16 | 19 |
| | 161 | 230 | 15 | 14 | 157 | 213 | 24 | 29 |
| | 157 | 230 | 16 | 14 | 148 | 209 | 28 | 36 |
| | 163 | 227 | 14 | 15 | 153 | 207 | 25 | 34 |
| | 157 | 225 | 14 | 13 | 159 | 212 | 16 | 19 |
| Goal | 140 | 215 | 15 | 15 | 140 | 194 | 12 | 12 |
| B1A Example B solution 2090° F./2 Hrs./90 Sec. Oil Quench Delay Stabilize 1500° F./1 Hour/AC Age 1350° F./8 Hrs./AC | | | | | | | | |
| | 161 | 241 | 24 | 21 | 159 | 216 | 27 | 31 |
| | 161 | 239 | 21 | 20 | 159 | 213 | 22 | 27 |
| | 160 | 235 | 19 | 17 | 158 | 209 | 27 | 33 |
| | 165 | 239 | 20 | 19 | 158 | 209 | 24 | 29 |
| | 158 | 235 | 19 | 19 | 157 | 215 | 24 | 28 |
| Goal | 140 | 215 | 15 | 15 | 140 | 194 | 12 | 12 |
| B1B Example B Solution 2090° F./2 Hrs./90 Sec. Oil Quench | | | | | | | | |

TABLE II-continued

MECHANICAL PROPERTIES - FIRST HEAT TREAT ITERATION

| | | | | | | | | |
|---|---|---|---|---|---|---|---|---|
| Delay Stabilize 1600° F./1 Hour/AC Age 1350° F./8 Hrs./AC | | | | | | | | |
| | 159 | 227 | 15 | 14 | 158 | 213 | 22 | 26 |
| | 158 | 221 | 13 | 12 | | Invalid Test | | |
| | 159 | 233 | 17 | 16 | 156 | 206 | 28 | 34 |
| | 159 | 229 | 15 | 15 | 155 | 210 | 27 | 33 |
| | 156 | 223 | 13 | 13 | 164 | 215 | 12 | 15 |
| Goal | 140 | 215 | 15 | 15 | 140 | 194 | 12 | 12 |
| C1A Example C solution 2065° F./2 Hrs./15 Sec. Oil Quench Delay Stabilize 1600° F./1 Hour/AC Age 1350° F./8 Hrs./AC | | | | | | | | |
| | 162 | 223 | 13 | 13 | 165 | 220 | 15 | 17 |
| | 159 | 231 | 17 | 15 | 158 | 211 | 17 | 20 |
| | 158 | 215 | 13 | 11 | 155 | 208 | 20 | 21 |
| | 164 | 235 | 16 | 16 | 155 | 209 | 25 | 30 |
| | 158 | 195 | 9 | 7 | 156 | 206 | 9.5 | 13 |
| Goal | 140 | 215 | 15 | 15 | 140 | 194 | 12 | 12 |
| D1A Example D Solution 2090° F./2 Hrs./Direct Oil Quench Stabilize 1600° F./1 Hour/AC Age 1350° F./8 Hrs./AC | | | | | | | | |
| | 164 | 232 | 15 | 15 | 165 | 218 | 14 | 17 |
| | 161 | 235 | 17 | 16 | 158 | 213 | 22 | 25 |
| | 157 | 231 | 17 | 16 | 155 | 213 | 24 | 25 |
| | 160 | 231 | 15 | 13 | 155 | 213 | 25 | 28 |
| | 165 | 222 | 11 | 12 | 158 | 209 | 10 | 12 |
| Goal | 140 | 215 | 15 | 15 | 140 | 194 | 12 | 12 |
| D1B Example D Solution 2065° F./2 Hrs./Direct Oil Quench Stabilize 1600° F./1 Hour/AC Age 1350° F./8 Hrs./AC | | | | | | | | |
| | 163 | 230 | 14 | 15 | 161 | 215 | 15 | 16 |
| | 159 | 231 | 16 | 15 | 159 | 213 | 20 | 22 |
| | 157 | 233 | 17 | 15 | 155 | 209 | 23 | 24 |
| | 164 | 232 | 15 | 12 | 161 | 218 | 20 | 21 |
| | 156 | 212 | 10 | 12 | 155 | 212 | 12 | 16 |
| Goal | 140 | 215 | 15 | 15 | 140 | 194 | 12 | 12 |

| | COMBINATION STRESS RUPTURE Kt = 3.6 Temperature 1350° F. Stress 95 KSI | | MICROSTRUCTURAL EVALUATION ASTM GRAIN SIZE | | | |
|---|---|---|---|---|---|---|
| | | | AS-HIP | | FORGED & HEAT TREATED* | |
| SERIAL NO. | STRESS HRS. | % EL | AVG. | ALA | AVG. | ALA |
| A1B | 27.2 | Notch | 10 | 8 | 12 | 8 |
| | 24.9 | Notch | | | | |
| B1A | 19.5 | Notch | 10 | 9 | 12 | 8 |
| | 24.5 | Notch | | | | |
| B1B | 29.7 | Notch | 10 | 9 | 12 | 8 |
| | 25.9 | Notch | | | | |
| C1A | 25.4 | Notch | 10 | 9 | 12 | 9 |
| | 27.6 | Notch | | | | |
| D1A | 40.1 | 14 | 9 | 8 | 12 | 8 |
| | 37.4 | Notch | | | | |
| D1B | 30.8 | Notch | 9 | 8 | 12 | 9 |
| | 31.8 | 11 | | | | |
| Goal | 23 | 5 | | | | |

*MICROSTRUCTURAL REVIEW INDICATED MICROSTRUCTUAL UNIFORMITY FROM RIM TO BORE

TABLE III

MECHANICAL PROPERTIES - SECOND HEAT TREAT ITERATION

| | | | | TENSILE PROPERTIES | | | | | COMBINATION STRESS RUPTURE 1350° | | |
|---|---|---|---|---|---|---|---|---|---|---|---|
| NUMBER | SOLUTION* | STABILIZE* | AGE* | TEST TEMP* | YS | UTS | % EL | % RA | LOAD | HRS. | % EL |
| A1BT | 2090°/2 H/ Oil Quench | 1600° F./40 min/AC | 1350°/8 H/AC | R.T. | 162 | 235 | 26 | 30 | 95 | 41.8 | Notch |
| | | 1800°/45 min/AC | | 1150 | 160 | 213 | 20 | 22 | | | |
| B1AT | 2090°/4 H/ Oil Quench | 1750°/4 H Total Furnace Time/AC | 1350°/8 H/AC | R.T. | 164 | 237 | 21 | 21 | 95 | 36.1+ | Notch |
| | | | | 1150 | 162 | 216 | 18 | 18 | | | |
| B1BT | 2090°/2 H/ | None | 1350°/8 H/AC | R.T. | 164 | 240 | 25 | 27 | 95 | 65.5 | Notch |
| | | | | 1150 | 161 | 219 | 23 | 23 | | | |
| D1AT | 2090°/2 H/ Oil Quench | 1600°/30 Min. Total Furnace Time | 1350°/8 H/AC | R.T. | 164 | 241 | 24 | 24 | 95 | 116.8 | 10 |
| | | | | 1150 | 159 | 217 | 22 | 20 | | | |
| | | | Goals | RT | 140 | 215 | 15 | 15 | 95 | 23 | 5 |

TABLE III-continued

| MECHANICAL PROPERTIES - SECOND HEAT TREAT ITERATION | | | | | | | | | | | |
|---|---|---|---|---|---|---|---|---|---|---|---|
| | | | | TENSILE PROPERTIES | | | | | COMBINATION STRESS RUPTURE 1350° | | |
| NUMBER | SOLUTION* | STABILIZE* | AGE* | TEST TEMP* | YS | UTS | % EL | % RA | LOAD | HRS. | % EL |
| | | | | 1150 | 140 | 194 | 12 | 12 | | | |

*Temperature in °F.

TABLE IV

MECHANICAL PROPERTIES - THIRD HEAT TREAT ITERATION

| | ROOM TEMPERATURE TENSILE | | | | 1150° F. ELEVATED TEMPERATURE TENSILE | | | |
|---|---|---|---|---|---|---|---|---|
| | Y.S. | UTS | % EL | % RA | Y.S. | UTS | % EL | % RA |
| A1AA Quarter Section Solution 2090°/2 H/90 Sec Oil Quench Delay Stabilize 1800°/2 H/AC Age 1350°/8 H/AC | | | | | | | | |
| | 153 | 230 | 28 | 26 | Void - Testing Problem | | | |
| | 153 | 232 | 28 | 28 | 152 | 200 | 29 | 31 |
| | 152 | 230 | 26 | 24 | 152 | 207 | 26 | 29 |
| | 153 | 232 | 28 | 28 | 152 | 204 | 29 | 33 |
| | 153 | 230 | 26 | 25 | 152 | 204 | 24 | 27 |
| Goal | 140 | 215 | 15 | 15 | 140 | 194 | 12 | 12 |
| A1AB Quarter Section Solution 2090°/2 H/90 Sec Oil Quench Delay Stabilize 1800°/4 H/AC Age 1350°/8 H/AC | | | | | | | | |
| | 152 | 231 | 28 | 27 | 153 | 204 | 26 | 21 |
| | 153 | 230 | 27 | 26 | 152 | 201 | 25 | 27 |
| | 150 | 229 | 28 | 26 | 151 | 204 | 26 | 29 |
| | 151 | 229 | 28 | 27 | 153 | 201 | 26 | 32 |
| | 152 | 230 | 26 | 24 | 152 | 202 | 22 | 26 |
| Goal | 140 | 215 | 15 | 15 | 140 | 194 | 12 | 12 |
| C1BA Quarter Section Solution 2090°/2 H/90 Sec Oil Quench Delay Stabilize 1600°/1 H/AC Age 1350°/8 H/AC ReStabilize 1800°/Time to Reach Temperature/AC Re-Age 1350°/8 H/AC | | | | | | | | |
| | 153 | 232 | 26 | 27 | 152 | 206 | 25 | 29 |
| | 154 | 232 | 26 | 27 | 154 | 202 | 26 | 29 |
| | 154 | 230 | 25 | 25 | 151 | 212 | 26 | 34 |
| | 151 | 229 | 22 | 22 | 154 | 211 | 26 | 32 |
| | 151 | 214 | 15 | 15 | 153 | 207 | 18 | 19 |
| Goal | 140 | 215 | 15 | 15 | 140 | 194 | 12 | 12 |
| C1BB —100 Mesh Quarter Section Solution 2090°/2 H/90 Sec Oil Quench Delay Stabilize 1600°/30 min Total F.T./AC (1400° F. Max. Temp.) | | | | | | | | |
| | 160 | 239 | 27 | 27 | 158 | 216 | 24 | 20 |
| | 158 | 238 | 24 | 23 | 158 | 212 | 25 | 27 |
| | 158 | 240 | 27 | 26 | Void | | | |
| | 165 | 243 | 26 | 25 | Void | | | |
| | 155 | 232 | 20 | 15 | 155 | 214 | 20 | 17 |
| Goal | 140 | 215 | 15 | 15 | 140 | 194 | 12 | 12 |

| SERIAL NUMBER | COMBINATION STRESS RUPTURE STRESS HOURS | % EL | FAIL LOC. | HOURS TO 0.1% | CREEP 1300° F. AT 80 KSI HOURS TO 0.2% |
|---|---|---|---|---|---|
| A1AA | 40.3 | — | Notch | 146 | 181 |
| A1AB | 48.3 | 5.5 | Smooth | 109 | 152 |
| C1BA | 81.8 | — | Notch | 227 | Test Dis-continued |
| C1BB | 40.9 | 6 | Notch | 125 | 155 |
| Goal | 23 | 5 | | — | 100 |

TABLE V

FIRST STAGE TURBINE DISC - HEAT NO. 022081 - HEAT CODE SERIAL NO. 2001

| Test Identity | Yield KSI | Ultimate KSI | % El 4D | % RA |
|---|---|---|---|---|
| ROOM TEMPERATURE TENSILE | | | | |
| O.D. - Tangential | 147 | 225 | 27 | 26 |
| Web - Radial | 148 | 225 | 28 | 29 |
| Bore - Tangential | 156 | 230 | 25 | 26 |
| Spacer - Tangential | 153 | 230 | 26 | 24 |
| Integral - Tangential | 159 | 234 | 25 | 26 |

TABLE V-continued

FIRST STAGE TURBINE DISC - HEAT NO. 022081 - HEAT CODE SERIAL NO. 2001

| | | | | |
|---|---|---|---|---|
| Goal | 140 | 215 | 15 | 15 |
| ELEVATED TEMPERATURE TENSILE - 1150° F. | | | | |
| O.D. - Tangential | 151 | 202 | 26 | 31 |
| Web - Radial | 148 | 206 | 24 | 24 |
| Bore - Tangential | 152 | 208 | 28 | 34 |
| Spacer - Tangential | 149 | 201 | 27 | 29 |
| Integral - Tangential | 155 | 213 | 26 | 31 |
| Goal | 140 | 194 | 12 | 12 |

COMBINATION BAR STRESS RUPTURE @ 1350° F., 95 KSI

| Test Identity | Total Hours | % EL | Failure Loc. |
|---|---|---|---|
| O.D. - Tangential | 49.2 | 13 | Smooth |
| Bore - Tangential | 45.2 | 8.5 | Smooth |
| Integral - Tangential | 53.8 | 9.0 | Smooth |
| Specification (Min.) | 23.0 | 5.0 | |

CREEP RUPTURE TEST @ 1300° F., 80 KSI

| Test Identity | Creep Hrs. @ 0.1% | Creep Hrs. @ 0.2% |
|---|---|---|
| O.D. - Tangential | 120 | 166 |
| O.D. - Tangential | 88 | 152 |

ASTM GRAIN SIZE

| Test Identity | Average | As-Large-As |
|---|---|---|
| O.D. | 11 | 9 |
| Web | 11 | 9 |
| Bore | 12 | 9 |
| Spacer | 12 | 9 |
| Integral | 11 | 9 |

TABLE VI

FIRST STAGE TURBINE DISC - HEAT NO. M0029C, HEAT CODE CNDN SERIAL NO. 2001 - CROSS-SECTIONAL PROPERTY ANALYSIS

| TEST IDENTITY | YIELD STRENGTH (KSI) | ULTIMATE STRENGTH (KSI) | % EL 4D | % RA |
|---|---|---|---|---|
| ROOM TEMPERATURE TENSILE | | | | |
| O.D. TANGENTIAL | 151 | 228 | 22 | 28 |
| WEB RADIAL | 151 | 228 | 21 | 26 |
| BORE TANGENTIAL | 152 | 230 | 20 | 25 |
| SPACER TANGENTIAL | 152 | 229 | 21 | 24 |
| INTEGRAL TANGENTIAL | 154 | 230 | 21 | 27 |
| GOAL | 140 | 215 | 15 | 15 |
| ELEVATED TEMPERATURE TENSILE 1150° F. | | | | |
| O.D. TANGENTIAL | 150 | 203 | 27 | 31 |
| WEB RADIAL | 150 | 203 | 27 | 35 |
| BORE TANGENTIAL | 150 | 204 | 28 | 33 |
| SPACER TANGENTIAL | 147 | 203 | 26 | 33 |
| INTEGRAL TANGENTIAL | 148 | 203 | 26 | 33 |
| GOAL | 140 | 194 | 12 | 12 |

COMBINATION BAR STRESS RUPTURE 1350° F. AT 95 KSI

| TEST IDENTITY | TOTAL HOURS | % ELON-GATION | FAILURE LOCATION |
|---|---|---|---|

TABLE VI-continued

| FIRST STAGE TURBINE DISC - HEAT NO. M0029C, HEAT CODE CNDN SERIAL NO. 2001 - CROSS-SECTIONAL PROPERTY ANALYSIS | | | |
|---|---|---|---|
| O.D. TANGENTIAL | 47.1 | 11 | Smooth |
| BORE TANGENTIAL | 27.4 | 13 | Smooth |
| INTEGRAL TANGENTIAL | 35.3 | 11 | Notch |
| SMOOTH SECTION CONT. | 36.2 | 11 | Smooth |
| GOAL | 23.0 | 5.0 | |

| ASTM GRAIN SIZE | |
|---|---|
| TEST IDENTITY | AVERAGE |
| O.D. TANGENTIAL | |
| WEB RADIAL | 11 |
| BORE TANGENTIAL | 11 |
| SPACER TANGENTIAL | 11 |
| INTEGRAL TANGENTIAL | 11 |
| GOAL | 8 or Finer |

TABLE VII

| ROOM TEMPERATURE TENSILE | | | | |
|---|---|---|---|---|
| | YIELD STRENGTH 0.2% OFFSET MIN. KSI | TENSILE STRENGTH MIN. KSI | % ELONG. MIN. | % R.A. MIN. |
| 3rd Stage Disc | 160 | 230 | 28 | 25 |
| Goal | 150 | 215 | 15 | 15 |

| COMBINATION STRESS RUPTURE | | | | |
|---|---|---|---|---|
| | TEMPER-ATURE | STRESS KSI | TIME TO RUPTURE | % ELONG. |
| 3rd Stage Disc | 1350° F. | 92.5 | 38 Hrs. | 7 |
| 4th Stage Disc | 1350° F. | 92.5 | 52.8 | 15 |
| Goal | 1350° F. | 92.5 | 23.0 | 5 |

| CREEP | | | |
|---|---|---|---|
| | TEMPERATURE | STRESS KSI | TIME TO 0.2% |
| 3rd Stage Disc | 1300° F. | 80 | 177 |
| 4th Stage Disc | 1300° F. | 80 | 237 |
| Goal | 1300° F. | 80 | 100 |

We claim:

1. A method of heat treating an article of a nickel base alloy consisting essentially of, in weight percent, from 0.015% to 0.09% carbon, up to 0.020% manganese, up to 0.10% silicon, up to 0.010% phosphorus, up to 0.010% sulfur, 10.90% to 13.90% chrominum, 18.00% to 19.00% cobalt, 2.80% to 3.60% molybdenum, 4.15% to 4.50% titanium, 4.805 to 5.15% aluminum, 0.016% to 0.024% boron, up to 0.50% hafnium, up to 1.60% columbium, 0.04% to 0.08% zirconium, up to 0.05% tungsten, up to 0.98% vanadium, up to 0.30% iron, up to 0.075 copper, up to 0.0002% (2 ppm) lead, up to 0.00005% (0.5 ppm) bismuth, and balance essentially nickel, said method comprising the steps of:

(1) solution treating at 2050° F. to 2150° F. for about 2 hours and cooling at a rate at least as rapid as still air;

(2) stabilizing at 1750° F. to 1850° F. for ¼ to 4 hours and cooling at a rate at least as rapid as still air; and (3) precipitation hardening and air cooling;

whereby to precipitate grain boundary carbides to an acceptably low level, to obtain an optimum balance of tensile strength, stress rupture life and creep strength, and reduced residual stress in the article.

2. The method claimed in claim 1, wherein said solution treating comprises heating at 2090° F. for 2 hours and cooling by direct quenching or by delaying immersion into oil or its equivalent up to 3 minutes.

3. The method claimed in claim 1 or 2, wherein said stabilizing treatment comprises heating at 1800° F. for ½ to 4 hours, and air cooling.

4. The method claimed in claim 1, wherein said article after heat treatment exhibits a yield strength of at least 140 ksi, a tensile strength of at least 215 ksi and a percent elongation of at least 15% at room temperature, and a combination bar stress rupture life of at least 23 hours at 1350° F. and at least 92.5 ksi stress.

5. The method claimed in claim 1, wherein said article is fabricated from a powdered, hot isostatically pressed nickel base alloy having a particle size ranging from −100 to −325 mesh (U.S. Standard) by isothermal hot forging.

6. The method claimed in claim 4, wherein said alloy consists essentially of, in weight percent, from 0.015–0.035 carbon, 0.020 max. manganese, 0.10 max. silicon, 0.010 max. phosphorus, 0.010 max. sulfur, 11.90–12.90 chromium, 18.00–19.00 cobalt, 2.80–3.60 molybdenum, 4.15–4.50 titanium, 4.80–5.15 aluminum, 0.016–0.024 boron, 0.30–0.50 hafnium, 1.20–1.60 columbium, 0.04–0.08 zirconium, 0.05 max. tungsten, 0.30 max. iron, 0.07 max. copper, 0.10 max. vanadium 0.0002 (2 ppm) max. lead, 0.00005 (0.5 ppm) max. bismuth, 0.020 (200 ppm) max. oxygen, 0.005 (50 ppm) max. nitrogen and remainder nickel.

7. The method claimed in claim 4, wherein said alloy consists essentially of, in weight percent, from 0.015–0.035 carbon, 0.020 maximum manganese, 0.10 maximum silicon, 0.010 maximum phosphorus, 0.010 maximum sulfur, 10.90–13.90 chromium, 18.00–19.00 cobalt, 2.80–3.60 molybdenum, 4.15–4.50 titanium, 4.80–5.15 aluminum, 0.016–0.024 boron, 0.30–0.50 hafnium, 1.20–1.60 columbium, 0.04–0.08 zirconium, 0.05 maximum tungsten, 0.30 maximum iron, 0.07 maximum copper, 0.0002 (2 ppm) maximum lead, 0.00005 (0.5 ppm) maximum bismuth, and remainder nickel.

8. The method claimed in claim 1, hwerein said precipitation hardening is conducted at about 1350° F. for about 8 hours.

9. The method claimed in claim 1, wherein said precipitation hardening is conducted at about 1200° F. for about 24 hours, and at about 1400° F. for about 4 hours, said air cooling following each heating cycle.

10. In a method of heat treating an article of a nickel base alloy consisting essentially of, in weight percent, from 0.015% to 0.09% carbon, up to 0.020% manganese, up to 0.10% silicon, up to 0.010% phosphorus, up to 0.010% sulfur, 10.90% to 13.90% chromium, 18.00% to 19.00% cobalt, 2.80% to 3.60% molybdenum, 4.15% to 4.50% titanium, 4.80% to 5.15% aluminum, 0.016% to 0.024% boron, up to 0.50% hafnium, up to 1.60% columbium, 0.04% to 0.08% zirconium, up to 0.05% tungsten, up to 0.98% vanadium, up to 0.30% iron, up to 0.07% copper, up to 0.0002% lead, up to 0.00005% bismuth, and balance essentially nickel, said method including the steps of solution heat treating at 2050° to 2150° F. and cooling at a rate at least as rapid as still air, and precipitation hardening and air cooling, the improvement which comprises stabilizing, between said solution heat treating and said precipitation hardening steps, at 1750° to 1850° for ¼ to 4 hours and cooling at a rate at least as rapid as still air, whereby to precipitate grain boundary carbides to an acceptably low level, to obtain an optimum balance of tensile strength, stress rupture life and creep strength, and reduced residual stress in said article.

* * * * *